US011178979B2

(12) United States Patent
Downs

(10) Patent No.: US 11,178,979 B2
(45) Date of Patent: Nov. 23, 2021

(54) PROTECTIVE COVERS FOR BABY CARRIER RINGS

(71) Applicant: Emily Norah Downs, Woodbury, MN (US)

(72) Inventor: Emily Norah Downs, Woodbury, MN (US)

( * ) Notice: Subject to any disclaimer, the term of this patent is extended or adjusted under 35 U.S.C. 154(b) by 0 days.

(21) Appl. No.: 16/948,437

(22) Filed: Sep. 18, 2020

(65) Prior Publication Data

US 2021/0076843 A1 Mar. 18, 2021

Related U.S. Application Data

(60) Provisional application No. 62/973,122, filed on Sep. 18, 2019.

(51) Int. Cl.

| | |
|---|---|
| ***A47D 13/02*** | (2006.01) |
| ***A44B 1/14*** | (2006.01) |
| ***A44B 11/00*** | (2006.01) |
| ***D06F 95/00*** | (2006.01) |
| *A44B 11/25* | (2006.01) |

(52) U.S. Cl.

CPC ..... *A47D 13/02* (2013.01); *A44B 1/14* (2013.01); *A44B 11/2576* (2013.01); *D06F 95/008* (2013.01)

(58) Field of Classification Search

CPC .. A47D 13/02; A47D 13/025; Y10T 24/4095; A44B 11/2576; A44B 1/14; D06F 95/008

USPC ..... D3/229; 150/154, 163

See application file for complete search history.

(56) References Cited

U.S. PATENT DOCUMENTS

| | | | | | |
|---|---|---|---|---|---|
| 1,479,136 | A * | 1/1924 | Guinzburg | A45D 33/005 | 383/95 |
| 1,600,193 | A * | 9/1926 | Michaud | F42B 39/02 | 224/249 |
| 1,600,633 | A * | 9/1926 | Hildebrand | A45C 1/02 | 150/150 |
| 1,794,498 | A * | 3/1931 | Ridgway | E05B 19/24 | 40/330 |
| 1,906,264 | A * | 5/1933 | Higgins | A61H 3/02 | 135/73 |
| 2,048,255 | A * | 7/1936 | Ganz | A45D 33/006 | 132/307 |
| 2,253,816 | A * | 8/1941 | Sherwood | A41F 9/002 | 24/163 R |
| 2,577,898 | A * | 12/1951 | Lerma | A44B 11/003 | 24/163 FC |

(Continued)

FOREIGN PATENT DOCUMENTS

| | | | | |
|---|---|---|---|---|
| DE | 2360163 A | * | 12/1975 | A47H 21/00 |
| GB | 2243376 A | * | 10/1991 | B65D 33/24 |
| WO | WO-9721366 A1 | * | 6/1997 | A44B 11/2576 |

*Primary Examiner* — Justin M Larson

(74) *Attorney, Agent, or Firm* — Dunlap Bennett & Ludwig, PLLC; Anna L. Kinney

(57) ABSTRACT

The present invention provides a protective cover for a baby carrier ring and a set thereof. The protective cover is a pocket formed from a pair of washable shields having at least one fastener. The fabric pockets are conformable around baby carrier rings. Each pocket is removably attachable to a baby carrier ring with the fastener. The washable material of the pocket protects the ring from damage while, for example, washing, drying, storing, and shipping the baby carrier.

11 Claims, 4 Drawing Sheets

(56) References Cited

U.S. PATENT DOCUMENTS 2,602,482 A * 7/1952 Lyon ..... D06F 95/006 383/97
2,844,179 A * 7/1958 Koret ..... A45C 7/0086 150/111
3,063,487 A * 11/1962 Mullin ..... A45C 1/02 150/150
3,098,375 A * 7/1963 Friedler ..... D06F 95/008 68/235 R
3,584,349 A * 6/1971 Shubart ..... A44B 1/14 24/113 MP
3,616,498 A * 11/1971 Rosenthal ..... D06F 95/008 24/90.5
3,826,414 A * 7/1974 Valadez ..... E05B 75/00 224/231
3,870,208 A * 3/1975 Theodore ..... E05B 75/00 224/250
4,711,261 A * 12/1987 Rosenberg ..... A61H 3/02 128/DIG. 15
4,778,179 A * 10/1988 Balaz ..... A63B 60/58 150/163
4,901,407 A * 2/1990 Pandola ..... A44B 11/2576 24/442
D307,512 S * 5/1990 Woods ..... D2/639
4,939,824 A * 7/1990 Reed ..... A44B 11/2576 24/579.11
4,944,530 A * 7/1990 Spurrier ..... A44B 11/2576 24/633
4,961,251 A * 10/1990 Smith ..... A44B 11/2576 24/633
4,995,436 A * 2/1991 Cantor ..... A45C 1/00 150/102
5,071,126 A * 12/1991 Baugh ..... A63B 60/58 206/216
5,372,414 A * 12/1994 Lamonakis ..... A47K 10/025 15/209.1
5,526,924 A * 6/1996 Klutznick ..... A45C 11/04 206/5
5,617,617 A * 4/1997 Gustin ..... A44B 11/2576 24/579.11
D383,620 S * 9/1997 Smith ..... D6/407
D387,187 S * 12/1997 Connor ..... D11/200
D387,217 S * 12/1997 Lakoski ..... D6/407
D387,887 S * 12/1997 Jensen ..... D11/200
5,884,382 A * 3/1999 Hansen ..... A44B 11/2576 24/442
5,947,241 A * 9/1999 Rausch ..... A45C 13/00 190/108
5,950,887 A * 9/1999 Powell ..... A47D 13/025 224/158
5,991,928 A * 11/1999 Smith ..... D06F 95/008 2/300
6,138,331 A * 10/2000 Powers ..... A44B 11/2576 24/306
6,151,823 A * 11/2000 Gregory-Gillman ..... G09F 3/20 383/35
D434,592 S * 12/2000 Sankey ..... D6/407
6,170,658 B1 * 1/2001 Dering ..... G11B 33/0444 206/308.1
6,463,637 B1 * 10/2002 Carnahan ..... A44B 11/2576 24/578.15
D467,729 S * 12/2002 Vazquez ..... D3/238
6,789,671 B2 * 9/2004 Morrison ..... A45C 13/30 206/388
D511,895 S * 11/2005 Vish ..... D3/318
7,203,999 B2 * 4/2007 Bagot ..... A44B 1/123 2/46
7,228,598 B1 * 6/2007 Powers ..... A44B 1/14 24/113 R
7,506,418 B2 * 3/2009 Dingel ..... A44B 11/12 24/629
RE42,311 E * 4/2011 Rubin ..... B65D 81/3888 383/110
8,015,737 B2 * 9/2011 Venegas, Jr. ..... E01F 15/003 40/607.03
8,079,116 B2 * 12/2011 Ayers ..... B60P 7/0869 24/68 CD
D651,767 S * 1/2012 Dias ..... D30/153
D653,017 S * 1/2012 Hamlin ..... D2/639
D658,365 S * 5/2012 Schiffman ..... D3/232
8,491,191 B2 * 7/2013 Ackerman ..... B65D 33/24 383/37
8,844,588 B2 * 9/2014 Low ..... A63B 57/203 150/160
8,925,156 B2 * 1/2015 Zutis ..... A44B 11/005 24/1
9,038,878 B2 * 5/2015 Jones ..... F41B 5/1457 224/609
9,113,719 B2 * 8/2015 Kummerfeld ..... A47D 13/083
9,648,929 B2 * 5/2017 Tew ..... A44C 7/002
9,750,352 B2 * 9/2017 Harris ..... A47D 13/025
2002/0084011 A1 * 7/2002 Rochon ..... F04D 25/088 150/165
2005/0115997 A1 * 6/2005 Nouvel De La Fleche ..... E05B 75/00 224/162
2005/0121122 A1 * 6/2005 Kyle ..... A47J 37/108 150/154
2006/0060060 A1 * 3/2006 Breske ..... G10G 7/005 84/387 A
2006/0097020 A1 * 5/2006 Johnson ..... A61H 3/02 224/407
2008/0041897 A1 * 2/2008 Malhotra ..... A45C 11/00 224/199
2008/0308202 A1 * 12/2008 Timm ..... A44B 1/14 150/154
2010/0116856 A1 * 5/2010 Tompros ..... A47D 13/02 224/160
2011/0197365 A1 * 8/2011 Wadia ..... A47D 13/02 5/655
2012/0037284 A1 * 2/2012 Korbonski ..... A47D 13/02 150/154
2014/0352084 A1 * 12/2014 Mathey ..... E01D 19/16 14/22
2015/0168094 A1 * 6/2015 Jones ..... F41B 5/1449 224/576
2015/0216287 A1 * 8/2015 Matsushita ..... A45D 44/00 150/154
2018/0153229 A1 * 6/2018 Virgilio ..... A41D 1/02
2021/0076843 A1 * 3/2021 Downs ..... A47D 13/02

* cited by examiner

PROTECTIVE COVERS FOR BABY CARRIER RINGS

CROSS-REFERENCE TO RELATED APPLICATION

This application claims the benefit of priority of U.S. provisional application No. 62/973,122, filed Sep. 18, 2019, the contents of which are herein incorporated by reference.

BACKGROUND OF THE INVENTION

The present invention relates to protective articles for baby carrier rings and, more particularly, to fabric pockets for protection of baby carrier rings.

Many baby carrier manufacturers recommend putting a sock over the baby carrier rings to protect them from damage. Socks do not reliably stay in place, are cumbersome, and cover too much fabric/material on the carrier. Therefore, they do not adequately protect the baby carrier rings. Using socks to protect rings also inhibits the carrier fabric from being thoroughly cleaned when washing.

As can be seen, there is a need for a protective article for baby carrier rings that does not fall off and does not interfere with cleaning the baby carrier fabric.

The present invention provides ring wraps or pockets that attach to the rings of a baby carrier to protect the baby carrier rings from damage. The ring wraps have a fastener to keep them in place on the rings so that ring wraps do not slide off. The ring wraps do not envelope a large amount of material and do not interfere with washing a baby carrier.

SUMMARY OF THE INVENTION

In one aspect of the present invention, a protective cover for a baby carrier ring is provided, comprising a pocket formed from a pair of washable shields having at least one fastener.

In another aspect of the present invention, a protective cover set for baby carrier rings is provided, comprising a plurality of fabric pockets configured to conform around a plurality of baby carrier rings, wherein each of said plurality of fabric pockets is removably attachable to one of the plurality of baby carrier rings with at least one fastener.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

As used herein, the term "shield" refers to a device or part that serves as a protective cover or barrier.

Broadly, one embodiment of the present invention is a ring cover, comprising a washable material and a fastener, for protecting the rings on baby carriers from damage. The washable material of the cover generally protects the rings from damage while, for example, washing, drying, storing, and shipping, the baby carrier.

In some embodiments, the ring cover may be configured as a protective pocket having at least one fastener. The protective pocket may be installed by sliding it onto a baby carrier ring. In other embodiments, the ring cover may be a ring wrap configured as a toroidal sheath having at least one fastener. The ring wrap may be installed by wrapping it around the ring, leaving the area in the center of the ring open.

The materials of manufacture are not particularly limited. The washable material may be selected from a variety of textiles, including but not limited to the group consisting of fleece, fleece adhered to another fabric, other protective materials, and a combination thereof. The fastener may be, for example, selected from the group consisting of snaps, buttons, zippers, and hook-and-loop closures.

In an embodiment, the inventive pocket may be manufactured as follows. Fabric may be adhered to fleece with an iron-on adhesive activated by heat from an iron. The fleece and fabric may be cut into shields generally having the shape of a major segment of a circle and hemmed. Snaps or other fasteners may be installed near the center of each component in a manner known to a person skilled in the sewing art. The hemmed components may then be sewn or stitched together around the circumference of the circular portion to form pockets, preferably with the fleece portion on the interior of the pockets.

To use the inventive articles, one cover may be fastened in place over each ring on the baby carrier, holding the cover in place. In some embodiments, adjacent pockets may be snapped to one another to protect a plurality of rings.

Figure 1:
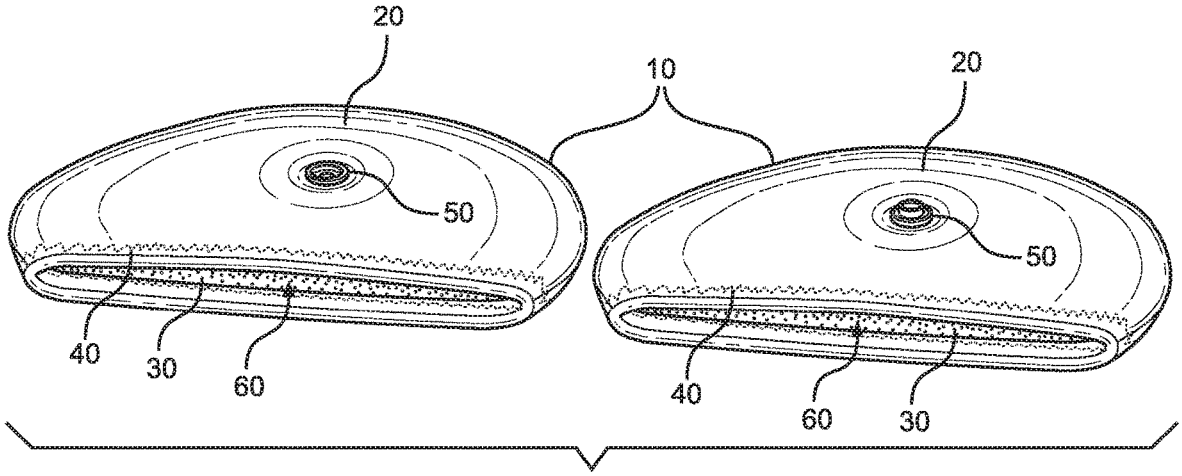
FIG. 1 is a top perspective view of two protective ring covers according to an embodiment of the invention.
Figure 2:
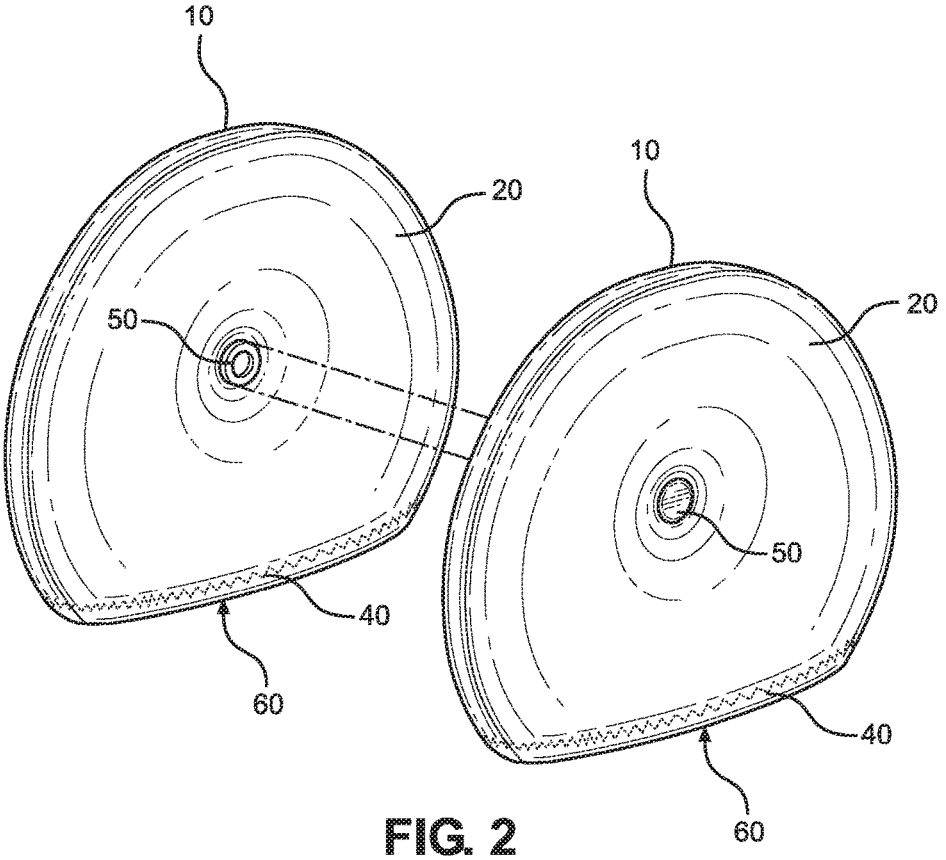
FIG. 2 is a front perspective view thereof.
Figure 3:
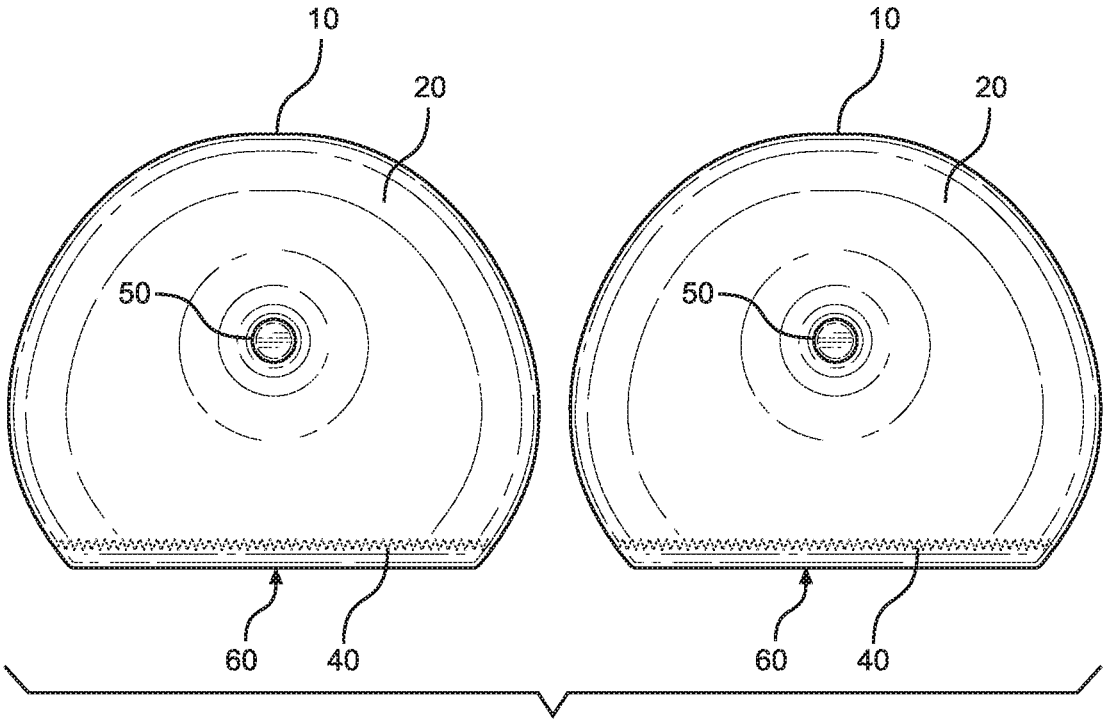
FIG. 3 is a top plan view thereof.
Figure 4:
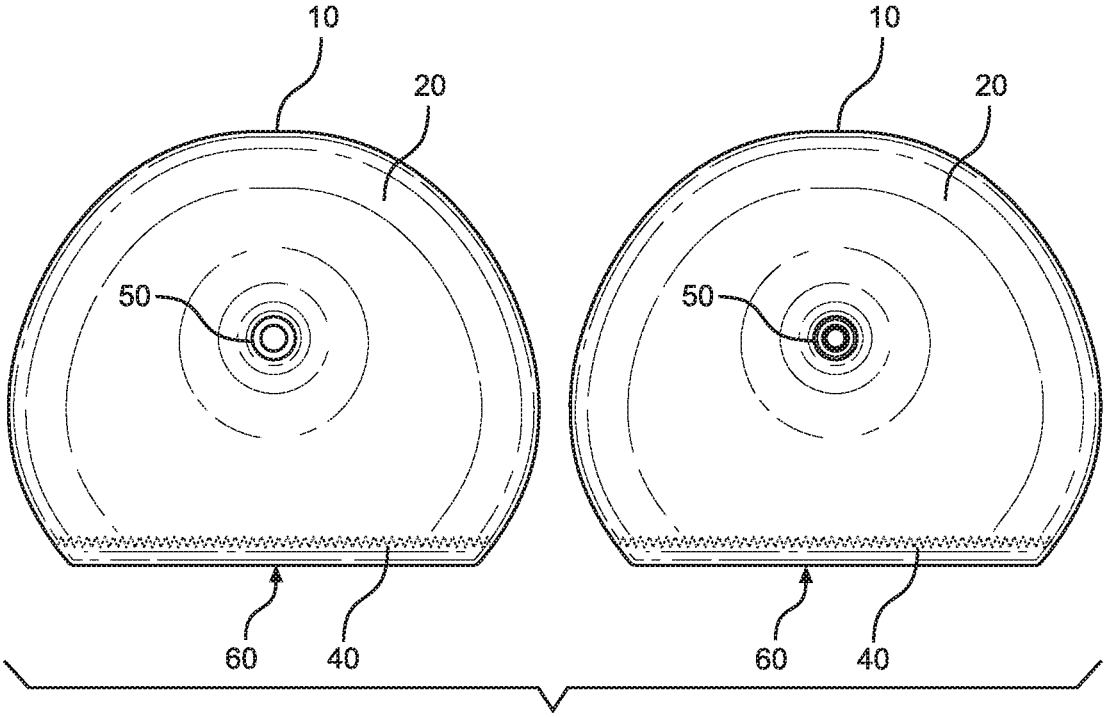
FIG. 4 is a bottom plan view thereof.
Figure 5:
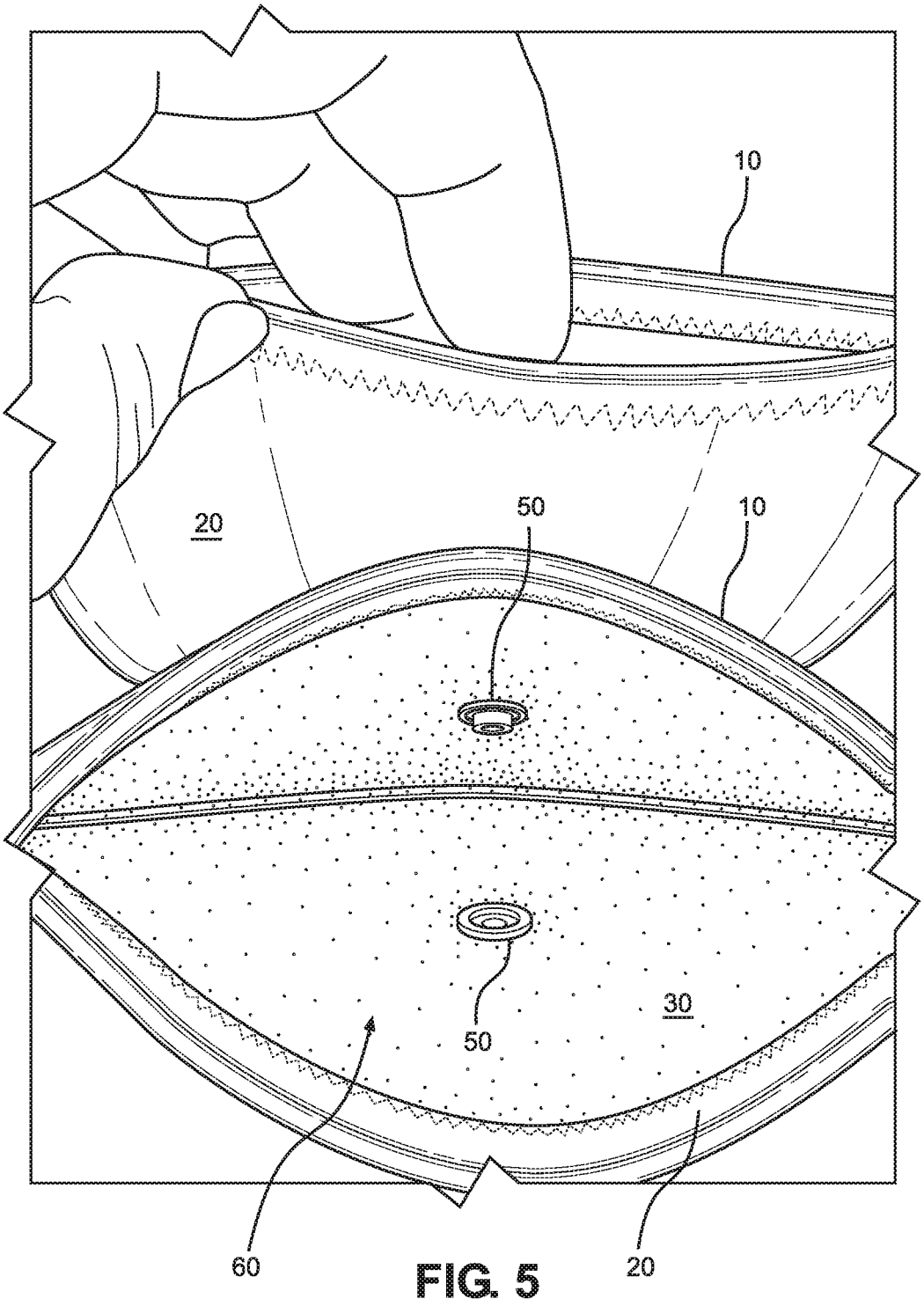
FIG. 5 is an enlarged view of the inside thereof.
Figure 6:
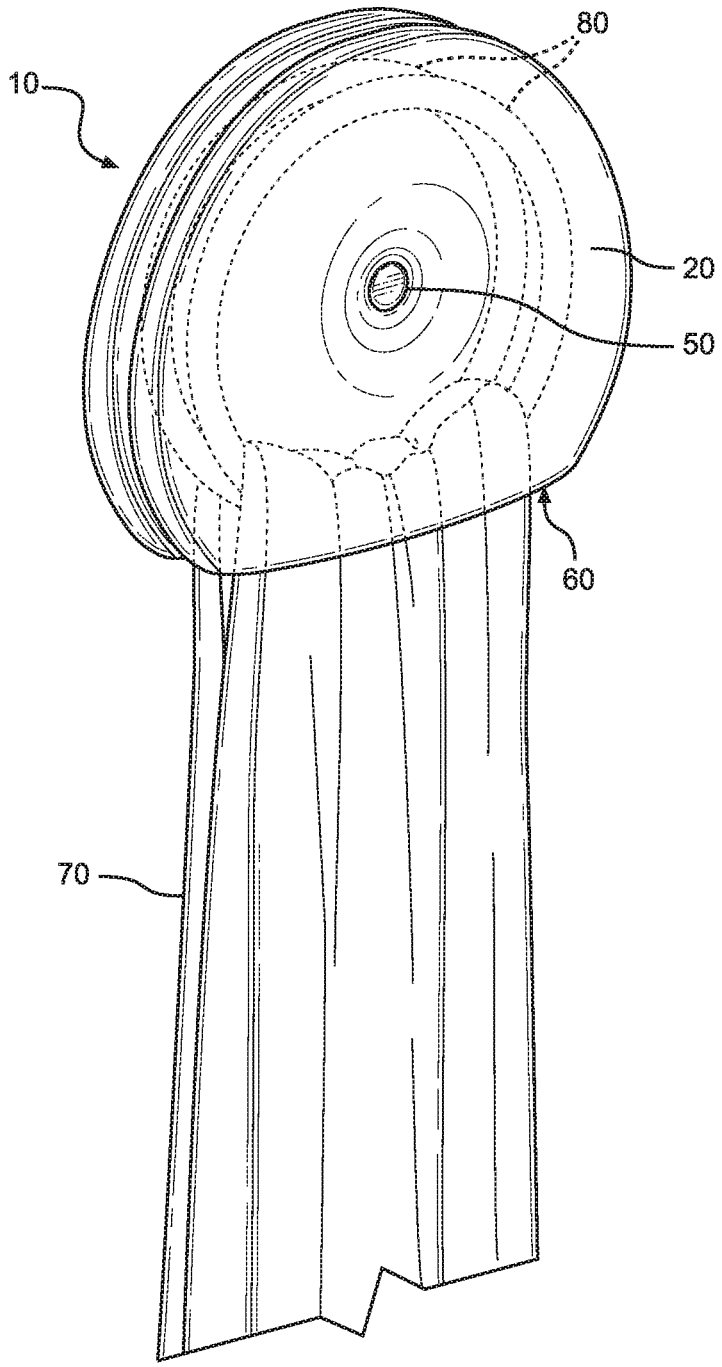
FIG. 6 is a perspective view thereof, shown in use with baby carrier rings secured within.

Referring to FIGS. 1 through 6, a pair of protective ring covers 10 according to an embodiment of the invention are shown. Each cover 10 comprises a fabric 20 pocket 60. Iron-on fleece 30 may be fused to the interior surface of the fabric 20 and the fabric 20 may be hemmed with thread 40. Snaps 50 may be installed near the center of each protective ring cover 10. FIG. 6 illustrates use of the inventive covers 10, such that a cover 10 surrounds each baby carrier ring 80 of a baby carrier 70.

It should be understood, of course, that the foregoing relates to exemplary embodiments of the invention and that modifications may be made without departing from the spirit and scope of the invention as set forth in the following claims.

What is claimed is:

1. A protective cover for a baby carrier ring, comprising a washable ring cover having an internal fastener, wherein the protective cover is configured in the shape of a major segment of a circle, and wherein the internal fastener is located closer to a center of the protective cover than an edge of the protective cover such that when the baby carrier ring is fully inserted into the protective cover, the internal fastener is located within an opening of the baby carrier ring in order to removably attach the protective cover to the baby carrier ring.

2. The protective cover of claim 1, wherein the washable ring cover comprises fleece adhered to another fabric.

3. The protective cover of claim 1, wherein the washable ring cover is configured as a sheath.

4. The protective cover of claim 1, wherein the washable ring cover k configured as a pocket formed from a pair of shields.

5. The protective cover of claim 4, wherein the pair of shields are stitched together around a circumference of the major segment of a circle to form the pocket.

6. The protective cover of claim 1, wherein the internal fastener is selected from the group consisting of snaps, buttons, and hook-and-loop closures.

7. The protective cover of claim 6, wherein the protective cover further comprises an external fastener attachable to an external fastener of an adjacent protective cover.

8. A protective cover set for baby carrier rings, comprising a plurality of fabric covers configured to conform around a plurality of baby carrier rings, wherein each of said plurality of fabric covers has an internal fastener, wherein each of said plurality of fabric covers is configured in the shape of a major segment of a circle, and wherein each of the internal fasteners is located closer to a center of a respective fabric cover than an edge of the respective fabric cover such that when the baby carrier rings are fully inserted into the fabric covers, each of the internal fasteners is located within an opening of a baby carrier ring in order to removably attach the fabric covers to the baby carrier rings.

9. The protective cover set of claim 8, wherein the plurality of fabric covers are configured as a pocket or as a sheath.

10. The protective cover set of claim 8, wherein the plurality of fabric covers are lined with fleece.

11. The protective cover set of claim 8, wherein each of said plurality of fabric covers further comprises an external fastener operable to attach adjacent fabric covers.

* * * * *